US008944755B2

(12) United States Patent
Lee

(10) Patent No.: US 8,944,755 B2
(45) Date of Patent: Feb. 3, 2015

(54) VARIABLE THROAT DEVICE FOR AIR COMPRESSOR

(75) Inventor: Jae Hyung Lee, Paju-si (KR)

(73) Assignee: Daejoo Machinery Co. Ltd. (KR)

( * ) Notice: Subject to any disclaimer, the term of this patent is extended or adjusted under 35 U.S.C. 154(b) by 561 days.

(21) Appl. No.: 13/292,154

(22) Filed: Nov. 9, 2011

(65) Prior Publication Data

US 2012/0237338 A1 Sep. 20, 2012

(30) Foreign Application Priority Data

Mar. 18, 2011 (KR) ..... 10-2011-0024156

(51) Int. Cl.
*F04D 29/40* (2006.01)
*F04D 29/42* (2006.01)

(52) U.S. Cl.
CPC ..... *F04D 29/4213* (2013.01)
USPC ..... 415/156

(58) Field of Classification Search
CPC ..... F04D 29/4213
USPC ..... 415/156, 159, 167; 251/212; 137/499, 137/504
See application file for complete search history.

(56) References Cited

U.S. PATENT DOCUMENTS

| | | | | | |
|---|---|---|---|---|---|
| 1,108,128 | A * | 8/1914 | Buffum | 138/45 |
| 2,037,663 | A * | 4/1936 | Lalor | 251/212 |
| 2,649,272 | A * | 8/1953 | Barbato | 251/212 |
| 2,934,892 | A * | 5/1960 | Hurlbert et al. | 239/265.39 |
| 3,068,891 | A * | 12/1962 | Panning et al. | 137/499 |
| 3,772,886 | A * | 11/1973 | Cameron | 60/221 |
| 3,787,022 | A * | 1/1974 | Wilcox | 251/212 |
| 4,092,010 | A * | 5/1978 | Carlson, Jr. | 251/4 |
| 4,459,922 | A * | 7/1984 | Chadshay | 110/265 |
| 5,821,475 | A * | 10/1998 | Morehead et al. | 181/255 |
| 6,948,696 | B1 * | 9/2005 | Aanonsen et al. | 251/4 |
| 8,191,571 | B2 * | 6/2012 | Himmelmann et al. | 137/521 |

* cited by examiner

*Primary Examiner* — Liam McDowell
(74) *Attorney, Agent, or Firm* — Schmeiser, Olsen & Watts, LLP

(57) ABSTRACT

A variable throat device for an air compressor, which is disposed in an air suction passage of an air compressor, and may secure reliable flow control by changing a cross-sectional area of the passage through application of force to the passage, significantly reduce a possibility of unsteady flow by suppressing generation of a vortex in an air stream, secure a desired flow rate without pressure loss in the air stream, and reduce fatigue load applied to a compressor impeller through stabilization of suction flow in order to achieve significant reduction of vibration of the impeller is provided.

9 Claims, 12 Drawing Sheets

(IGV Close)

(IGV Open)

VARIABLE THROAT DEVICE FOR AIR COMPRESSOR

FIELD OF TECHNOLOGY

The present invention relates to a variable throat device for an air compressor, and more particularly, to a variable throat device, which is disposed in an air suction passage of an air compressor, and may secure reliable flow control by changing a cross-sectional area of the passage through application of force to the passage, significantly reduce a possibility of unsteady flow by suppressing generation of a vortex in an air stream, secure a desired flow rate without to pressure loss in the air stream, and reduce fatigue load applied to a compressor impeller through stabilization of suction flow in order to achieve significant reduction of vibration of the impeller.

BACKGROUND

Generally, an air compressor includes an air suction pipe, an impeller rotated at high speed about a rotary shaft, a diffuser (diffusive flow passage) connected to an outlet of the impeller, and a discharge pipe through which compressed air ejected from the diffuser is discharged to the outside.

The suction pipe is provided with an inlet guide vane (IGV) which opens or closes a flow passage to regulate air flow into the impeller. The impeller accelerates and compresses air suctioned through the inlet guide vane, and the diffuser reduces noise and the flow speed of the air discharged at high pressure and high speed from the impeller while increasing blowing efficiency.

In FIGS. 1 and 2, a conventional inlet guide vane assembly includes an air suction pipe which guides a flow of air at atmospheric pressure towards the compressor, and variable vanes which protrude into the air suction pipe such that the angle of the vanes can be regulated by external force to allow variable regulation of a flow rate of suctioned air.

Such a conventional inlet guide vane assembly can regulate compression capacity of the compressor by regulating inflow amount, but reduces the discharge pressure and design flow rate of the compressor. Further, in the conventional inlet guide vane assembly, an unsteady flow is created due to generation of a large vortex downstream of the inlet guide vane (IGV), such that abnormal load is applied to impeller blades. Further, the vortex generated at the inlet guide vane causes fatigue of the compressor impeller, which reduces durability of the compressor, and unsteadiness and pressure loss of air flow passing through the inlet guide vane cause a reduction in discharge flow rate, even when the inlet guide vane is completely open. Further, a signification reduction in discharge flow rate occurs due to an increase of pressure loss resulting from opening and closing of the inlet guide vane, and unsteadiness of the flow is severe, thereby increasing load applied to the impeller. Therefore, there is a need for an air compressor which overcomes such problems of the related art.

SUMMARY

The present invention has been conceived to solve the problems of the related art and provides a variable throat device, which is disposed in an air suction passage of the air compressor to change a cross-sectional area of the passage through application of force to the passage in order to secure reliable flow control while achieving a significant reduction in to unsteady flow by suppressing generation of a vortex in an air stream. Accordingly, the variable throat device of the present invention secures a desired flow rate without pressure loss. In addition, the variable throat valve may reduce fatigue load applied to a compressor impeller through stabilization of suction flow, thereby significantly reducing vibration of the impeller. Therefore, the variable throat device according to the present invention may achieve energy saving through reduction of power loss.

In accordance with an aspect of the present invention, a variable throat device for an air compressor includes: a variable throat which is provided to an air suction pipe of the air compressor to secure reliable flow control through reduction of an unsteady air flow in the air suction pipe, and changes a cross-sectional area of the suction pipe to provide a streamlined air suction passage, which reduces load applied to a compressor impeller, thereby significantly reducing vibration of the impeller.

The variable throat may include a plurality of main wings arranged along a circular trace to overlap each other such that a degree of overlap between the main wings is changed by external force to have a variable diameter, each of the main wings having elasticity and being connected at one side or opposite sides thereof to the air suction pipe in an axial direction; and a plurality of main fastening mechanisms each fastening adjacent main wings to allow the degree of overlap between the main wings to be changed.

Each of the main wings may have one side overlapping an upper side of an adjacent main wing and the other side overlapping a lower side of another adjacent main wing to reduce an area of the device.

Each of the main fastening mechanisms may include an elongated slot circumferentially formed at the other side of each of the main wings; a hole formed at one side of each of the main wings along the same circumferential trace as that of the slot; and a fastening pin fastening the slot of one main wing to the hole of another main wing adjacent the one main wing, so that the adjacent main wings overlap each other by a movable range of the fastener.

The variable throat may further includes a plurality of elastic sub-wings arranged along a circular trace to overlap each other such that a degree of overlap between the sub-wings is changed by external force to allow the diameter of the main wings to be changed, and a plurality of sub-fastening mechanisms each fastening adjacent sub-wings such that the degree of overlap between the sub-wings is changed.

The diameter of the main wings may be changed by pushing force from a plurality of jaws circumferentially arranged to be moved forwards or backwards or to be rotated.

The variable throat may be disposed within a closed case.

The air suction pipe may include a plurality of outer wings having elasticity and arranged along a circular trace to overlap each other such that a degree of overlap between the outer wings gradually increases towards the variable throat in connection with variation of a diameter of the variable throat, and a plurality of outer fastening mechanisms each fastening adjacent outer wings to allow the degree of overlap between the outer wings to be gradually changed towards the variable throat in an axial direction of the outer wings.

Each of the outer fastening mechanisms may include an outer pivot hole formed at a portion of each of the outer wings placed at an opposite side to the variable throat in the axial direction; an outer pivot pin simultaneously inserted into adjacent outer pivot holes to maintain a diameter of a portion of the air suction pipe corresponding to the outer pivot pin; an elongated outer slot formed at the other side of each of the outer wings placed near the variable throat in the axial direction to be inclined with respect to a circumferential direction; an outer hole formed at one side of each of the outer wings to be coincident with the outer slot of an adjacent outer wing; and an outer fastening pin inserted into the outer slot of one outer wing and the outer hole of another outer wing adjacent the one outer wing to guide variation of a diameter of a portion of the air suction pipe corresponding to the outer fastening pin.

The air suction pipe may include a plurality of inner wings having elasticity and arranged along a circular trace to overlap each other to allow a degree of overlap therebetween to gradually increase towards the variable throat and to be changed according to pushing force of the outer wings, and a plurality of inner fastening mechanisms each fastening adjacent inner wings to allow the degree of overlap between the inner wings to be changed towards the variable throat in an axial direction of the inner wings.

BRIEF DESCRIPTION OF THE DRAWINGS

The above and other aspects, features and advantages of the present invention will become apparent from the following description of exemplary embodiments given in conjunction with the accompanying drawings, in which.

DETAILED DESCRIPTION

Exemplary embodiments will now be described in detail with reference to the accompanying drawings. It should be noted that the drawings are not to precise scale and may be exaggerated in thickness of lines or size of components for descriptive convenience and clarity only. Furthermore, the terms used herein are defined by taking functions of the present disclosure into account and can be changed according to user or operator's custom or intention. Therefore, definition of the terms should be made according to the overall disclosure set forth herein.

Figure 1:
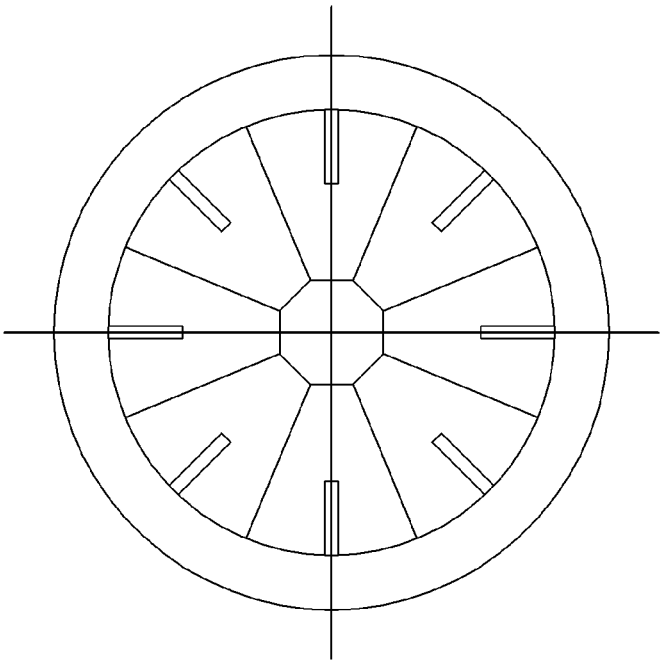
FIG. 1 Prior Art
FIG. 1 is a plan view of a conventional suction guide vane assembly for an air compressor in a closed state.
Figure 2:
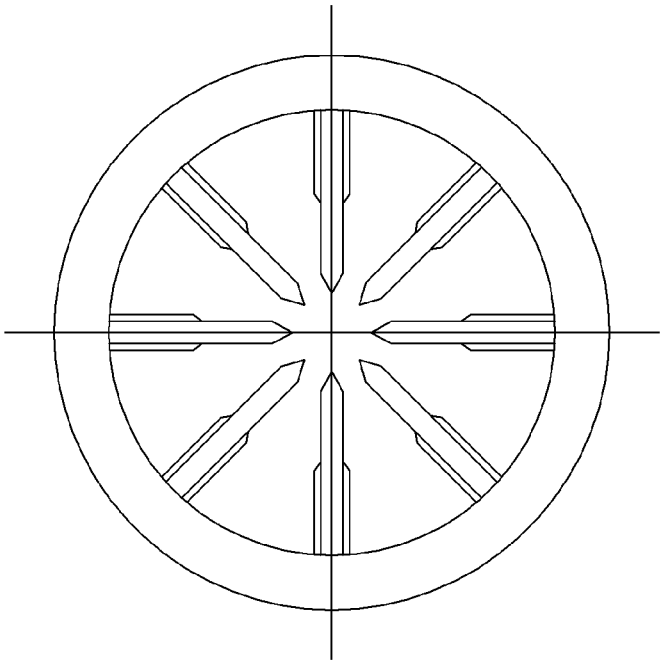
FIG. 2 Prior Art
FIG. 2 is a plan view of the conventional suction guide vane assembly for an air compressor in an open state.
Figure 3:
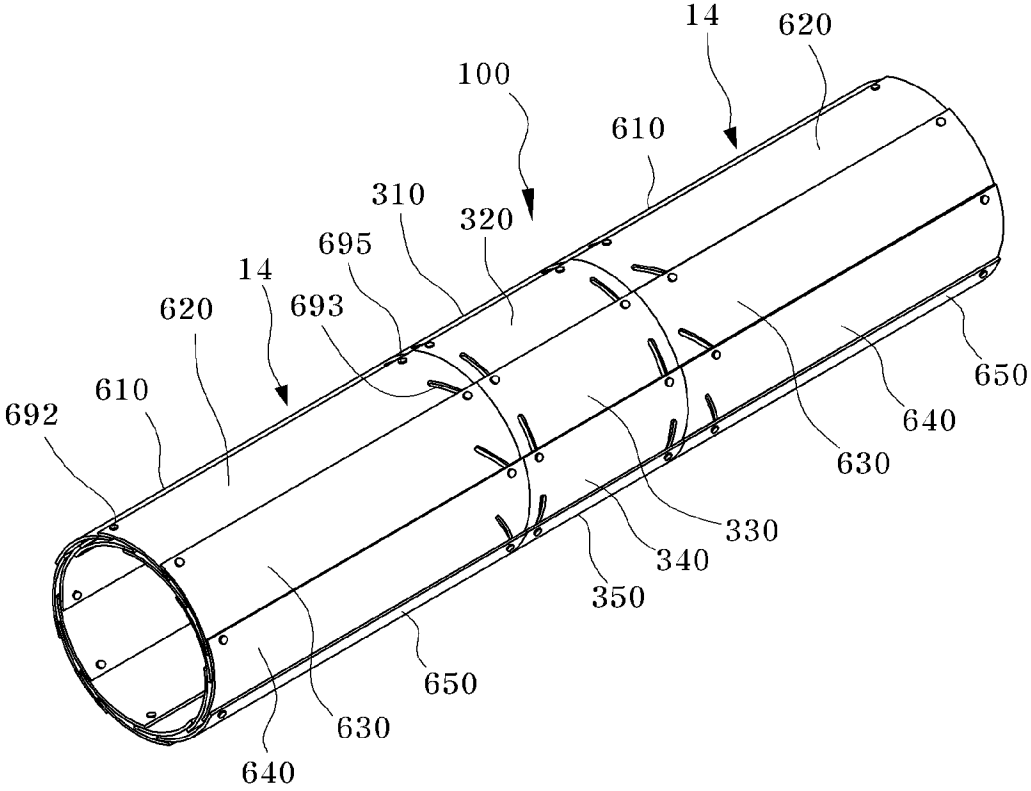
FIG. 3 is a perspective view of a variable throat device for an air compressor in accordance with one exemplary embodiment of the present invention, which is disposed in an air suction pipe of the compressor.
Figure 4:
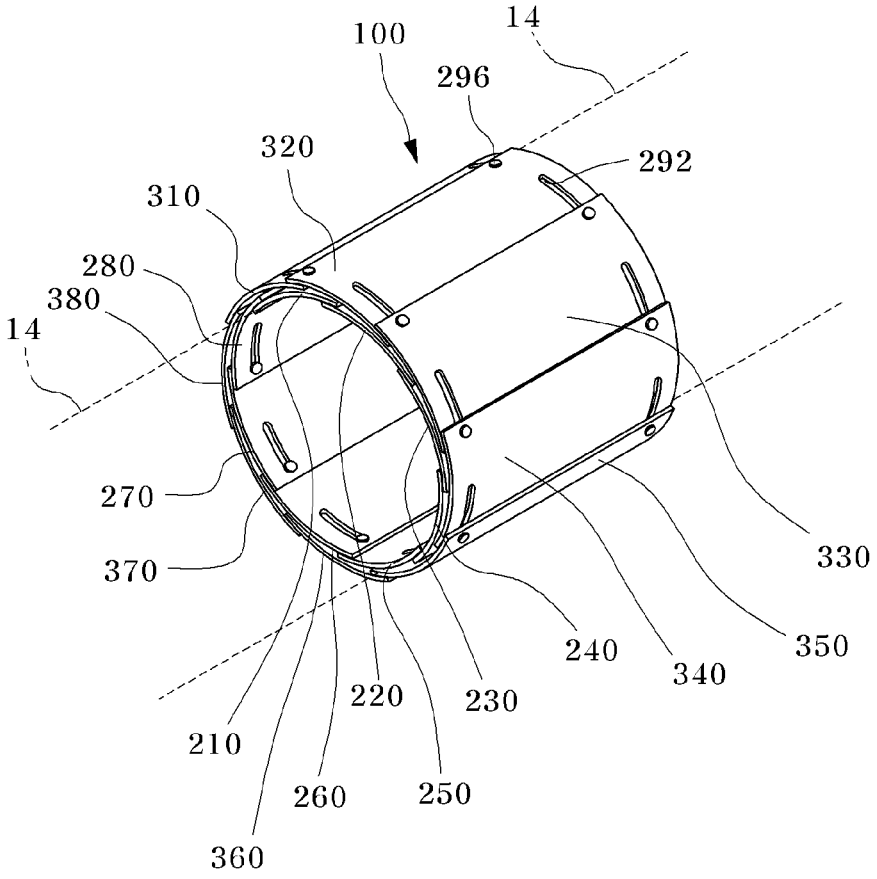
FIG. 4 is a perspective view of the variable throat device in accordance with the exemplary embodiment of the present invention.
Figure 5:
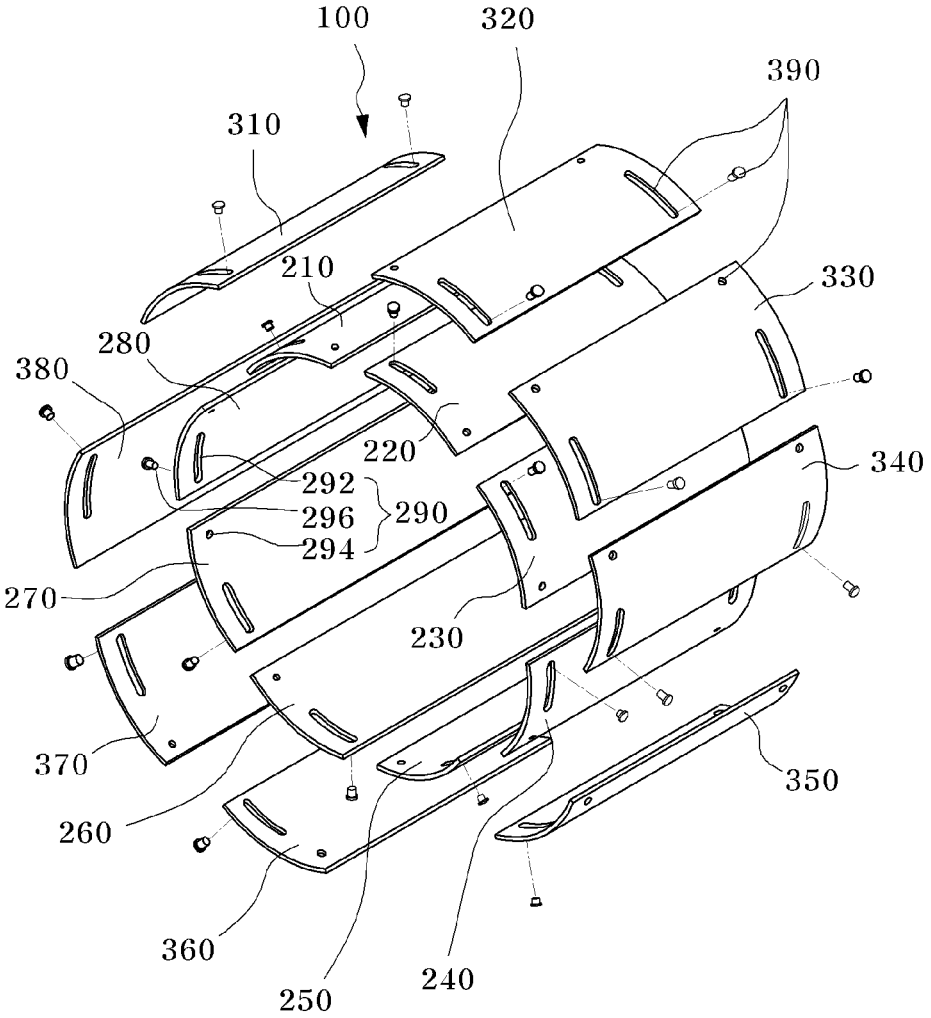
FIG. 5 is an exploded perspective view of the variable throat device in accordance with the exemplary embodiment of the present invention.

FIG. 3 is a perspective view of a variable throat device for an air compressor in accordance with one exemplary embodiment of the invention, which is disposed in an air suction pipe of the compressor; FIG. 4 is a perspective view of the variable throat device in accordance with the exemplary embodiment; and FIG. 5 is an exploded perspective view of the variable throat device in accordance with the exemplary embodiment.

Figure 6:
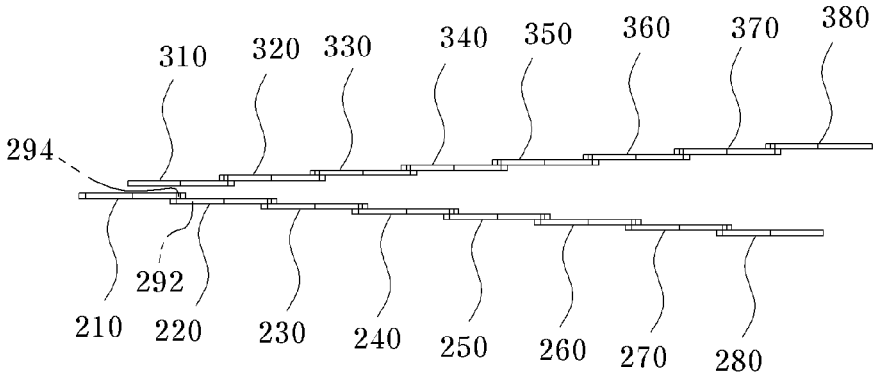
FIG. 6 is an exploded view of the variable throat device in accordance with the exemplary embodiment of the present invention.
Figure 7:
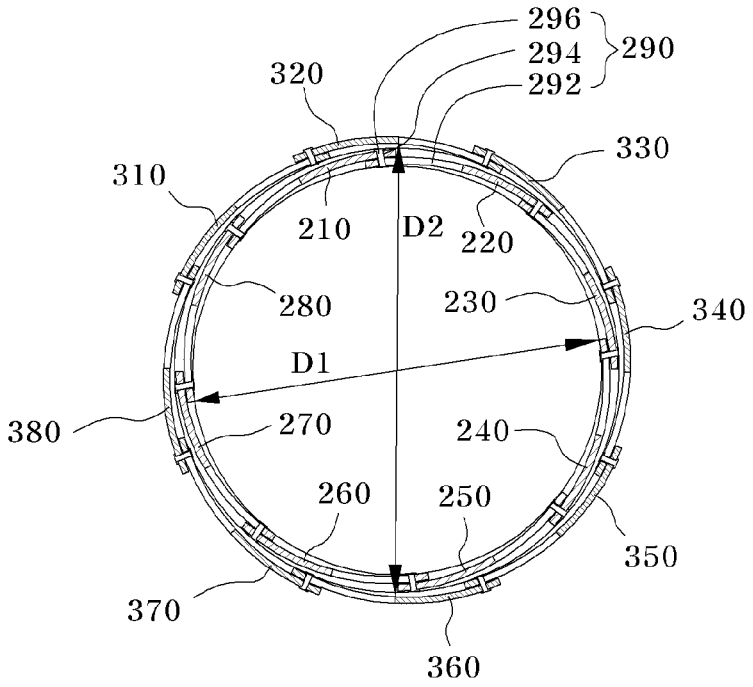
FIG. 7 is a cross-sectional view of the variable throat device in accordance with the exemplary embodiment of the present invention.

FIG. 6 is an exploded view of the variable throat device in accordance with the exemplary embodiment, and FIG. 7 is a cross-sectional view of the variable throat device in accordance with the exemplary embodiment.

Figure 8:
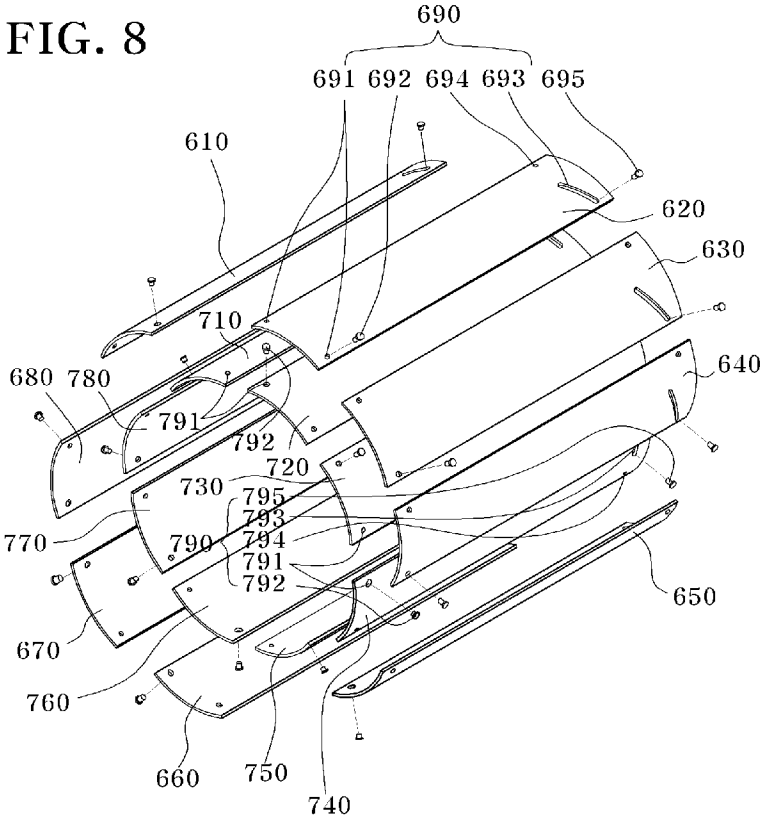
FIG. 8 is an exploded perspective view of an air suction pipe connected to the variable throat device in accordance with one exemplary embodiment of the present invention.
Figure 9:
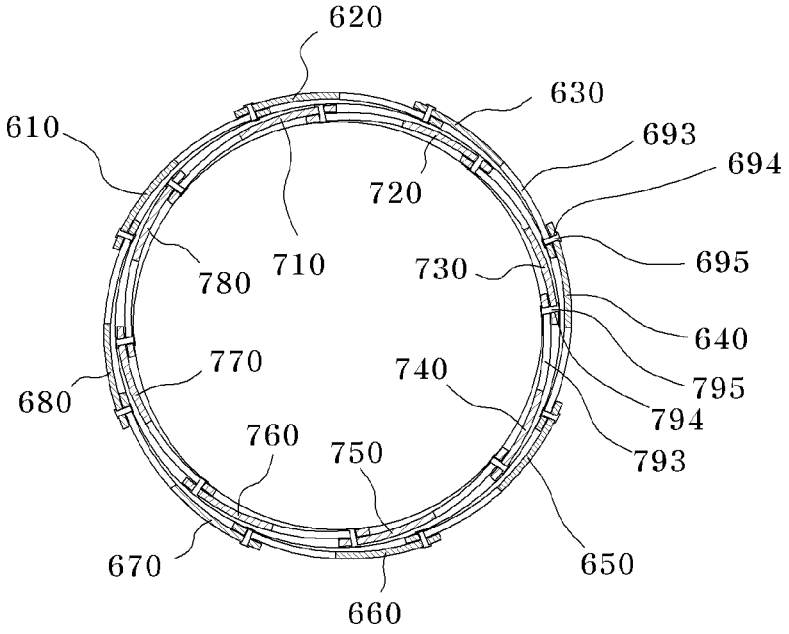
FIG. 9 is a cross-sectional view of the air suction pipe connected to the variable throat device in accordance with the exemplary embodiment of the present invention.

FIG. 8 is an exploded perspective view of an air suction pipe connected to the variable throat device in accordance with one exemplary embodiment, and FIG. 9 is a cross-sectional view of the air suction pipe connected to the variable throat device in accordance with the exemplary embodiment.

Figure 10:
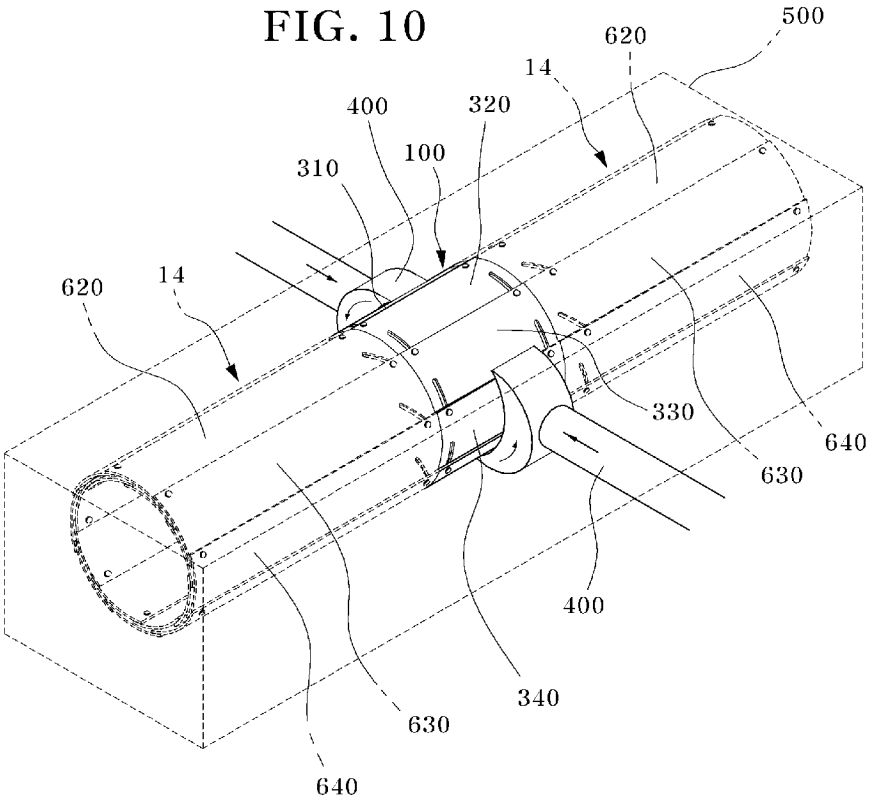
FIG. 10 is a diagram of the variable throat device when compressed by jaws in accordance with one exemplary embodiment of the present invention.
Figure 11:
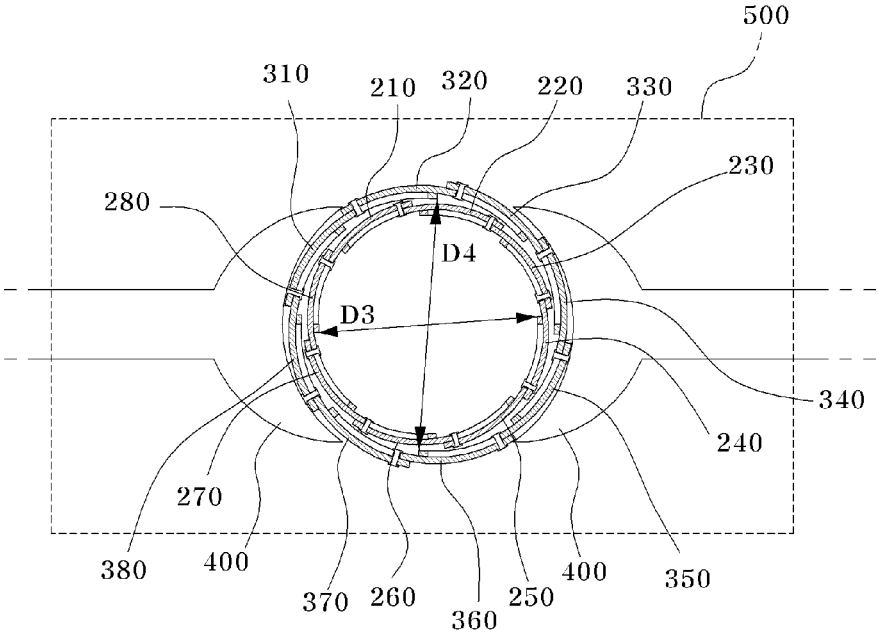
FIG. 11 is a cross-sectional view taken along line A-A of FIG. 10.
Figure 12:
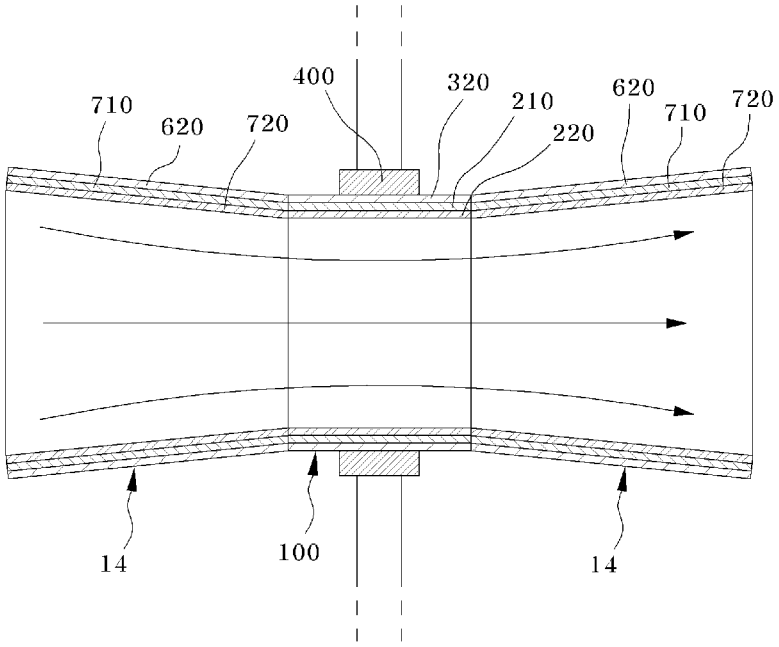
FIG. 12 is a cross-sectional view taken along line B-B of FIG. 10.

FIG. 10 is a diagram of the variable throat device when compressed by jaws, in accordance with one exemplary embodiment, FIG. 11 is a cross-sectional view taken along line A-A of FIG. 10, and FIG. 12 is a cross-sectional view taken along line B-B of FIG. 10.

Referring to FIG. 3 to FIG. 7, the variable throat device for an air compressor according to the exemplary embodiment includes a plurality of main wings 210~280 arranged along a circular trace to overlap each other and connected to an air suction pipe 14, such that the main wings 210~280 can be compressed by external force to change a diameter of the circular trace, thereby providing a streamlined air flow in the air suction pipe to secure reliable flow control while preventing generation of a vortex to achieve a significant reduction of a possibility of unsteady flow.

In other words, the variable throat device according to the exemplary embodiment includes a variable throat 100 provided to the air suction pipe 14, which guides a flow of air at atmospheric pressure into the compressor (not shown).

Although the air suction pipe 14 may be provided to one side of the variable throat 100 in an axial direction, the exemplary embodiment will be illustrated as including the air suction pipes 14 provided to opposite sides of the variable throat 100 for convenience of description.

The variable throat 100 may be configured to allow variation of a diameter thereof through application of external force, thereby enabling a reduction of unsteady flow while securing reliable flow control.

That is, the variable throat 100 provided to the air suction pipes 14 may guide a streamlined air flow therethrough. In addition, application of the variable throat 100 having a variable diameter may secure reliable flow control and desired flow rate without pressure loss, significantly reduce a possibility of unsteady flow without vortex generation, and reduce load applied to a compressor impeller through stabilization of suction flow to achieve a significant reduction in vibration of the impeller.

Further, the variable throat device minimizes a wind resistance coefficient, thereby realizing smooth air flow.

In one exemplary embodiment, the variable throat 100 includes a plurality of main wings 210, 220, 230, 240, 250, 260, 270, 280 and a plurality of main fastening mechanisms 290.

The plural main wings 210~280 are arranged along a circular trace to overlap each other. Thus, the main wings 210~280 enable change of a diameter thereof via application of external force. Specifically, the main wings 210~280 are arranged to allow variation in the cross-sectional area of a suction flow passage via external force. In addition, each of the main wings 210~280 is connected at one side or at opposite sides thereof to the air suction pipe 14. Obviously, the main wings 210~280 may be connected to the air suction pipe 14 in a variety of ways such as riveting, bolting, and the like. Particularly, the main wings 210~280 may be made using a thin plate in order to reduce vortex generation and pressure difference, and engage with each other to prevent air from being discharged to the outside through a gap therebetween.

For convenience, the variable throat according to this embodiment will be illustrated as including 8 main wings 210~280. In addition, since all of the main wings 210~280 are arranged along the circular trace and overlap each other to allow variation of the diameter in response to external force, the main wings 210~280 may have the same size along an arcuate trace.

Herein, the term "diameter" means a certain diameter D1 of a circular cross-section which is initially formed by the main wings 210~280 connected to each other along the circular trace.

Specifically, the main wings 210~280 include a first main wing 210, a second main wing 220, a third main wing 230, a fourth main wing 240, a fifth main wing 250, a sixth main wing 260, a seventh main wing 270, and an eighth main wing 280 in the clockwise direction along the circular trace. Herein, the main wings 210~280 commonly refer to the first main wing 210, the second main wing 220, the third main wing 230, the fourth main wing 240, the fifth main wing 250, the sixth main wing 260, the seventh main wing 270, and the eighth main wing 280, which are connected to one another.

In the clockwise direction, one side of the first main wing 210 overlaps an upper side of the second main wing 220 adjacent the first main wing 210, and the other side of the first main wing 210 overlaps a lower side of the eighth main wing 280 which is also adjacent the first main wing 210.

Similarly, one side of the second main wing 220 overlaps an upper side of the third main wing 230 and the other side of the second main wing 220 overlaps a lower side of the first main wing 210.

The third main wing 230, the fourth main wing 240, the fifth main wing 250, the sixth main wing 260, the seventh main wing 270, and the eighth main wing 280 are also arranged in the same manner as that of the first and second main wings (see FIG. 6). Accordingly, when the degree of overlap between the main wings 210~280 is increased by application of external force thereto, the diameter is decreased. Thus, the amount of air flowing inside the circular trace formed by the main wings 210~280 is regulated.

Further, each of the main fastening mechanisms 290 fastens the main wings 210~280 adjacent each other so as to allow change of the degree of overlap between the main wings. Specifically, since each of the main wings 210~280 is fastened by the main fastening mechanism 290, the main wings 210~280 are connected to one another to maintain the circular trace.

In one exemplary embodiment, the main fastening mechanism 290 includes a slot 292, a hole 294, and a fastening pin 296.

The slot 292 has an elongated shape and is circumferentially formed at the other side of each of the main wings 210~280, and the hole 294 is formed at one side of each of the main wings 210~280 along the same circumferential trace of the slot 292.

In other words, the hole 294 has a circular shape and is formed at the one side of the first main wing 210 overlapping the upper side of the second main wing 220, and the elongated slot 292 is formed at the other side of the first main wing 210 overlapping the lower side of the eighth main wing 280. Obviously, each of the main wings 210~280 may be formed at opposite sides thereof with slots 292 having the same configuration.

The slot 292 is configured to allow adjacent main wings to overlap each other. Here, a long side of the slot 292 may have any diameter.

Further, the fastening pin 296 serves to fasten the slot 292 and the hole 294, which overlap each other. Here, the fastening pin 296 may be a rivet.

For example, the fastening pin 296 fastens the slot 292 of the first main wing 210 and the hole 294 of the eighth main wing 280.

When the main wings 210~280 are initially arranged to overlap each other, an edge of each main wing is subjected to bending force in a normal direction while being gradually moved to overlap an edge of another main wing adjacent thereto. In this case, the fastening pin 296 can be broken, and the main wings 210~280 constituting the circular trace can undergo severe deformation from the circular trace.

Thus, the main wings 210~280 connected to one another may be supported at outer sides thereof.

Accordingly, the variable throat 100 further includes a plurality of sub-wings 310, 320, 330, 340, 350, 360, 370, 380 and a plurality of sub-fastening mechanisms 390.

The plural sub-wings 310~380 have elastic restoring force and are arranged along a circular trace to overlap each other such that the degree of overlap between the sub-wings 310~380 is changed by external force to change the diameter of the circular trace formed by the main wings 210~280 connected to one another.

Here, the respective sub-wings 310~380 are arranged corresponding to connecting portions between the main wings 210~280.

In addition, each of the sub-wings 310~380 is made using a thin plate. Further, each of the sub-wings 310~380 may be connected at one side thereof or at opposite sides thereof to the air suction pipe 14. Alternatively, the sub-wings may be disconnected therefrom.

For convenience, the variable throat according to this embodiment will be illustrated as including 8 sub-wings 310~380. In addition, since all of the sub-wings 310~380 are arranged along the circular trace and overlap each other to allow variation of a diameter thereof in response to external force, the sub-wings 310~380 may have the same size along an arcuate trace.

Herein, the term "diameter" means a certain diameter D2 of a circular cross-section which is initially formed by the sub-wings 310~380 connected to one another.

Specifically, the sub-wings 310~380 include a first sub-wing 310, a second sub-wing 320, a third sub-wing 330, a fourth sub-wing 340, a fifth sub-wing 350, a sixth sub-wing 360, a seventh sub-wing 370, and an eighth sub-wing 380 in the clockwise direction along the circular trace. Herein, the sub-wings 310~380 commonly refer to the first sub-wing 310, the second sub-wing 320, the third sub-wing 330, the fourth sub-wing 340, the fifth sub-wing 350, the sixth sub-wing 360, the seventh sub-wing 370, and the eighth sub-wing 380 connected to one another.

In the clockwise direction, one side of the first sub-wing 310 overlaps a lower side of the second sub-wing 320 adjacent the first sub-wing 310, and the other side of the first sub-wing 310 overlaps an upper side of the eighth sub-wing 380 which is also adjacent the first sub-wing 310.

Similarly, one side of the second sub-wing 320 overlaps a lower side of the third sub-wing 330 and the other side of the second sub-wing 320 overlaps an upper side of the first sub-wing 310.

The third sub-wing 330, the fourth sub-wing 340, the fifth sub-wing 350, the sixth sub-wing 360, the seventh sub-wing 370, and the eighth sub-wing 380 are also arranged in the same manner as the first and second sub-wings (see FIG. 6). Accordingly, when the degree of overlap between the respective sub-wings 310~380 is increased by application of external force, the diameter is decreased. Thus, the amount of air flowing inside the circular trace formed by the sub-wings 310~380 is regulated.

In particular, the respective sub-wings 310~380 are arranged to overlap connecting portions between the respective main wings 210~280. For example, a connecting portion between the first main wing 210 and the second main wing 220 corresponds to the second sub-wing 320, and a connecting portion between the second main wing 220 and the third main wing 230 corresponds to the third sub-wing 330.

Further, each of the sub-fastening mechanisms 390 fastens the sub-wings 310~380 adjacent each other so as to allow change of the degree of overlap between the sub-wings. Specifically, since each of the sub-wings 310~380 is fastened by the sub-fastening mechanism 390, the sub-wings 310~380 are connected to one another to maintain the circular trace.

In one exemplary embodiment, the sub-fastening mechanism 390 includes a slot 292, a hole 294, and a fastening pin 296. The shapes and functions of the slot 292, the hole 294 and the fastening pin 296 are the same as those described above.

Consequently, the first main wing 210 overlaps the lower side of the eighth main wing 280 by a movable range of the fastening pin 296 in the slot 292.

Similarly, the second main wing 220 moves to the lower side of the first main wing 210 to overlap each other, the third main wing 230 moves to the lower side of the second main wing 220 to overlap each other, and the fourth main wing 240 moves to the lower side of the third main wing 230 to overlap each other.

In addition, the fifth main wing 250 moves to the lower side of the fourth main wing 240 to overlap each other, the sixth main wing 260 moves to the lower side of the fifth main wing 250 to overlap each other, and the seventh main wing 270 moves to the lower side of the sixth main wing 260 to overlap each other, and the eighth main wing 280 moves to the lower side of the seventh main wing 270 to overlap each other.

Further, the first sub-wing 310 overlaps the lower side of the second sub-wing 320 by a movable distance of the fastening pin 296 in the slot 292.

Similarly, the second sub-wing 320 moves to the lower side of the third sub-wing 330 to overlap each other, the third sub-wing 330 moves to the lower side of the fourth sub-wing 340 to overlap each other, and the fourth sub-wing 340 moves to the lower side of the fifth sub-wing 350 to overlap each other.

In addition, the fifth sub-wing 350 moves to the lower side of the sixth sub-wing 360 to overlap each other, the sixth sub-wing 360 moves to the lower side of the seventh sub-wing 370 to overlap each other, the seventh sub-wing 370 moves to the lower side of the eighth sub-wing 380 to overlap each other, and the eighth sub-wing 380 moves to the lower side of the first sub-wing 310 to overlap each other.

In other words, the overlapping direction of the main wings 210~280 is opposite the overlapping direction of the sub-wings 310~380. This arrangement enables minute variation of the diameter of the main wings 210~280 by interference of the sub-wings 310~380 moving in one direction along an arc of a circle with the main wings 210~280 moving in the other direction.

As shown in FIGS. 3,8 and 9, the air suction pipe 14 includes a plurality of outer wings 610, 620, 630, 640, 650, 660, 670, 680 associated with the main wings 210~280, and a plurality of inner wings 710, 720, 730, 740, 750, 760, 770, 780 associated with the sub-wings 310~380.

Particularly, the outer wings 610~680 are arranged along a circular trace to overlap each other such that the degree of overlap between the outer wings 610~680 is gradually increased towards the variable throat 100. The outer wings 610~680 are made of an elastic material and a diameter of the outer wings 610~680 varies in association with variation of the diameter of the variable throat 100.

More specifically, the outer wings 610~680 are arranged along the circular trace so as to be respectively connected to the sub-wings 310~380 while overlapping each other. Thus, the diameter of the outer wings 610~680 varies in association with variation of the diameter of the sub-wings 310~380, which is varied by jaws 400. In addition, the outer wings 610~680 are connected to opposite ends of the corresponding sub-wings 310~380 in the axial direction. Here, the outer wings 610~680 are connected to opposite ends of the corresponding sub-wings 310~380 in various ways such as through riveting, bolting, and the like. In particular, as in the sub-wings 310~380, the outer wings 610~680 may be made using a thin plate to reduce vortex generation and pressure difference, and engage with each other to prevent air from being discharged to the outside through a gap therebetween.

Specifically, the outer wings 610~680 may be connected to the sub-wings 310~380 in the axial direction so as to provide one-to-one correspondence. The outer wings 610~680 include a first outer wing 610, a second outer wing 620, a third outer wing 630, a fourth outer wing 640, a fifth outer wing 650, a sixth outer wing 660, a seventh outer wing 670, and an eighth outer wing 680 in the clockwise direction along the circular trace. Herein, the outer wings 610~680 commonly refer to the first outer wing 610, the second outer wing 620, the third outer wing 630, the fourth outer wing 640, the fifth outer wing 650, the sixth outer wing 660, the seventh outer wing 670, and the eighth outer wing 680 connected to one another.

In the clockwise direction, one side of the first outer wing 610 overlaps an upper side of the second outer wing 620 adjacent the first outer wing 610, and the other side of the first outer wing 610 overlaps a lower side of the eighth outer wing 680 which is also adjacent the first outer wing 610.

Similarly, one side of the second outer wing 620 overlaps an upper side of the third outer wing 630 adjacent the second outer wing 620, and the other side of the second outer wing 620 overlaps a lower side of the first outer wing 610.

The third outer wing 630, the fourth outer wing 640, the fifth outer wing 650, the sixth outer wing 660, the seventh outer wing 670, and the eighth outer wing 680 are also arranged in the same manner as the first and second outer wings (see FIG. 9).

For convenience, FIGS. 8 and 9 show the outer wings 610~680 each connected to one end of each of the sub-wings 310~380 in the axial direction. Obviously, the outer wings 610~680 each connected to the other end of each of the sub-wings 310~380 have the same arrangement as that of the outer wings 610~680 each connected to one end of each of the sub-wings 310~380.

Further, the outer wings 610~680 may be connected to one another such that the degree of overlap between the outer wings can be gradually changed towards the variable throat 100.

Thus, each of the outer fastening mechanisms 690 fastens adjacent outer wings to each other such that the degree of overlap therebetween can be gradually changed in the axial direction.

That is, since each of the outer wings 610~680 is fastened by the outer fastening mechanism 690, the outer wings 610~680 maintain the circular trace while being changed to different diameters in association with the sub-wings 310~380 in the axial direction.

In one exemplary embodiment, each of the outer fastening mechanisms 690 includes outer pivot holes 691, an outer pivot pin 692, an outer slot 693, an outer hole 694, and an outer fastening pin 695.

The outer pivot holes 691 are formed at a portion of each of the outer wings 610~680 placed at an opposite side to the variable throat 100 in the axial direction. In other words, the outer pivot holes 691 are formed at an edge of each of the outer wings 610~680 placed at the opposite side to the sub-wings 310~380 in the axial direction.

Since the respective outer wings 610~680 are arranged to overlap each other, each of the outer wings 610~680 includes at least two outer pivot holes 691. Here, each of the outer pivot holes 691 is a hole having a predetermined diameter.

Each of the outer pivot pins 692 is inserted into the outer pivot holes 691 adjacent each other at the same time and maintains a diameter of a portion of the air suction pipe 14 corresponding to the outer pivot pin 692.

Specifically, the outer pivot pin 692 is simultaneously inserted into the outer pivot holes 691, which are placed coincident with each other, so that the edges of the outer wings 610~680 placed at an opposite side to the sub-wings 310~380 maintain the diameters thereof. In particular, the respective outer wings 610~680 are allowed to rotate with respect to the outer pivot pins 692.

Herein, the outer pivot pin 692 may be a rivet.

The outer slot 693 has an elongated shape and is formed at the other side of each of the outer wings 610~680 placed near the variable throat 100 in the axial direction to be inclined with respect to the circumferential direction. The outer hole 694 is formed at one side of each of the outer wings 610~680 to overlap the outer slot 693 of another outer wing adjacent thereto.

In other words, the outer slot 693 is circumferentially formed at an edge of each of the outer wings 610~680 placed near the sub wings 310~380, and has an elongated shape inclined relative to a line perpendicular to the axial direction of the air suction pipe 14.

Here, the outer slot 693 has the same trace as that of each of the outer wings 610~680 which are rotated with respect to the outer pivot pins 692.

In addition, the outer holes 694 are circumferentially formed at one side of each of the outer wings 610~680.

In other words, the outer hole 694 has a circular shape and is formed at one side of the first outer wing 610 overlapping the upper side of the second outer wing 620, and the outer slot 693 is formed at the other side of the first outer wing 610 overlapping the lower side of the eighth outer wing 680. Obviously, each of the outer wings 610~680 may be formed at opposite sides thereof with outer slots 693 having the same configuration.

The outer slot 693 is configured to allow adjacent outer wings to overlap each other while regulating the degree of overlap therebetween. Here, a long side of the outer slot 693 may have any diameter.

Further, each of the outer fastening pins 695 is inserted into the outer slot 693 of one outer wing and into the outer hole 694 of another outer wing to guide variation of a diameter of a portion of the air suction pipe 14 corresponding to these outer wings into which the outer fastening pin 692 is inserted.

That is, each of the outer fastening pins 695 serves to fasten the outer slot 693 and the outer hole 694, which overlap each other. Here, the outer fastening pin 695 may be a rivet.

For example, the outer fastening pin 695 fastens the outer slot 693 of the first outer wing 610 and the outer hole 694 of the eighth outer wing 680.

Accordingly, the degree of overlap between the outer wings 610~680 gradually increases towards the sub-wings 310~380.

As in the main wings 210~280, a plurality of inner wings 710, 720, 730, 740, 750, 760, 770, 780 is disposed inside the outer wings 610~680.

The plural inner wings 710~780 are made of an elastic material and arranged along a circular trace to overlap each other such that the degree of overlap gradually increases towards the variable throat 100 and is changed by pushing force of the outer wings 610~680.

In other words, the inner wings 710~780 have elastic restoring force and are arranged to overlap each other along the circular trace such that a diameter of the inner wings 710~780 is gradually changed in association with the main wings 210~280.

Here, the respective inner wings 710~780 are arranged corresponding to connecting portions between the outer wings 610~680.

In addition, each of the inner wings 710~780 is made using a thin plate.

For convenience, the variable throat according to this embodiment will be illustrated as including 8 inner wings 710~780. In addition, all of the inner wings 710~780 are arranged along the circular trace.

Specifically, the inner wings 710~780 include a first inner wing 710, a second inner wing 720, a third inner wing 730, a fourth inner wing 740, a fifth inner wing 750, a sixth inner wing 760, a seventh inner wing 770, and an eighth inner wing 780 in the clockwise direction along the circular trace. Herein, the inner wings 710~780 commonly refer to the first inner wing 710, the second inner wing 720, the third inner wing 730, the fourth inner wing 740, the fifth inner wing 750, the sixth inner wing 760, the seventh inner wing 770, and the eighth inner wing 780 connected to one another.

In the clockwise direction, one side of the first inner wing 710 overlaps a lower side of the second inner wing 720 adjacent the first inner wing 710, and the other side of the first inner wing 710 overlaps an upper side of the eighth inner wing 780 which is also adjacent the first inner wing 710.

Similarly, one side of the second inner wing 720 overlaps a lower side of the third inner wing 730 and the other side of the second inner wing 720 overlaps an upper side of the first inner wing 710.

The third inner wing 730, the fourth inner wing 740, the fifth inner wing 750, the sixth inner wing 760, the seventh inner wing 770, and the eighth inner wing 780 are also arranged in the same manner as the first and second inner wings (see FIG. 9).

For convenience, FIGS. 8 and 9 show the inner wings 710~780 each connected to one end of each of the main wings 210~280 in the axial direction. Obviously, the inner wings 710~780 each connected to the other end of each of the main wings 210~280 have the same arrangement as that of the inner wings 710~780 each connected to one end of each of the main wings 210~280.

Further, the inner wings 710~780 may be connected to one another such that the degree of overlap therebetween can be gradually changed towards the variable throat 100.

Thus, each of the inner fastening mechanisms 790 fastens adjacent inner wings to each other such that the degree of overlap between inner wings 710~780 can be gradually changed in the axial direction.

In other words, since each of the inner wings 710~780 is fastened by the inner fastening mechanism 790, the inner wings 710~780 maintain the circular trace while being changed to different diameters in association with the main wings 210~280 in the axial direction.

In one exemplary embodiment, each of the inner fastening mechanisms 790 includes inner pivot holes 791, an inner pivot pin 792, an inner slot 793, an inner hole 794, and an inner fastening pin 795.

The inner pivot holes 791 are formed at a portion of each of the inner wings 710~780 placed at an opposite side to the variable throat 100 in the axial direction. In other words, the inner pivot holes 791 are formed at an edge of each of the inner wings 710~780 placed at the opposite side to the main wings 210~280 in the axial direction.

Since the respective inner wings 710~780 are arranged to overlap each other, each of the inner wings 710~780 includes at least two inner pivot holes 791. Here, each of the inner pivot holes 791 is a hole having a predetermined diameter.

Each of the inner pivot pins 792 is simultaneously inserted into the inner pivot holes 791 adjacent each other and maintains a diameter of a portion of the air suction pipe 14 corresponding to the inner pivot pin 792.

Specifically, the inner pivot pin 792 is simultaneously inserted into the inner pivot holes 791, which are placed coincident with each other, so that the edges of the inner wings 710~780 placed at an opposite side to the main wings 210~280 maintain the diameter thereof. In particular, the respective inner wings 710~780 are allowed to rotate with respect to the inner pivot pins 792.

Here, each of the inner pivot pins 792 may be a rivet.

The inner slot 793 has an elongated shape and is formed at the other side of each of the inner wings 710~780 placed near the variable throat 100 in the axial direction to be inclined with respect to the circumferential direction. The inner hole 794 is formed at one side of each of the inner wings 710~780 to overlap the inner slot 793 of another inner wing adjacent thereto.

In other words, the inner slot 793 is circumferentially formed at an edge of each of the inner wings 710~780 placed near the main wings 210~280, and has an elongated shape inclined relative to a line perpendicular to the axial direction of the air suction pipe 14.

Here, the inner slot 793 has the same trace as that of each of the inner wings 710~780 which are rotated with respect to the inner pivot pin 792.

In addition, the inner holes 794 are circumferentially formed at one side of each of the inner wings 710~780.

In other words, the first inner wing 710 is formed with the inner hole 794 at one side thereof overlapping with the upper side of the second inner wing 720, and formed with the inner slot 793 at the other side thereof overlapping the lower side of the eighth inner wing 780. Obviously, each of the inner wings 710~780 may be formed at opposite sides thereof with inner slots 793 having the same configuration.

The inner slot 793 is configured to allow adjacent inner wings 710~780 to overlap each other while regulating the degree of overlap therebetween. Here, a long side of the inner slot 793 may have any diameter.

Further, each of the inner fastening pins 795 is inserted into the inner slot 793 of one inner wing and into the inner hole 794 of another inner wing to guide variation of a diameter of a portion of the air suction pipe 14 corresponding to the inner fastening pin 795.

That is, each of the inner fastening pins 795 serves to fasten the inner slot 793 and the inner hole 794, which overlap each other. Here, the inner fastening pin 795 may be a rivet.

For example, the inner fastening pin 795 fastens the inner slot 793 of the first inner wing 710 and the inner hole 794 of the eighth inner wing 780.

Accordingly, the degree of overlap between the inner wings 710~780 gradually increases towards the main wings 210~280.

On the other hand, in the variable throat 100, the diameter of the main wings 210~280 arranged to overlap each other in the circular trace and the diameter of the sub-wings 310~380 arranged to overlap each other along the circular trace may be changed by an operator. The diameter of the variable throat 100 may be changed in various ways.

For example, the diameter of the main wings 210~280 may be changed by a plurality of jaws 400 circumferentially arranged to be moved forwards or backwards, as shown in FIGS. 10 to 12.

Specifically, the plural jaws 400 directly change the diameter of the sub-wings 310~380 disposed outside the main wings 210~280.

The sub-wings 310~380 are decreased in diameter from an initial diameter D2 to a decreased diameter D4 by pushing force of the jaws 400 which are rotated in one direction while moving forwards. Then, the main wings 210~280 are decreased in diameter from an initial diameter D1 to a decreased diameter D3 by clamping force of the sub-wings 310~380.

Thus, as the diameters of the sub-wings 310~380 and the main wings 210~280 are changed by external pushing force, resistance to air flow may be minimized to prevent vortex generation, thereby securing reliable flow control.

At this time, the outer slots 693 may be inclined by any angle and in any direction with respect to the circumferential direction of the outer wings 610~680. Similarly, the inner slot 793 may be inclined by any angle and in any direction with respect to the circumferential direction of the inner wings 710~780.

In particular, the jaws 400 are rotated and moved in a lateral direction by various devices, which may include a cylinder for rotation (not shown) and a cylinder for lateral movement (not shown).

Here, the sub-wings 310~380 are connected to the jaws 400 to return to an original state when the jaws 400 are moved backwards. In one embodiment, the jaws 400 may be welded to some of the sub-wings 310~380.

On the other hand, gaps created between the main wings 210~280, which are connected to each other, and between the sub-wings 310~380, which are connected to each other, make it difficult to achieve accurate control of a flow rate of air flowing in the axial direction.

Thus, the variable throat 100 constituted by the sub-wings 310~380 and the main wings 210~280 may be received inside a closed case 500.

That is, the closed case 500 blocks air flow except for the air flow in the axial direction of the sub-wings 310~380 and main wings 210~280, thereby allowing accurate control of the flow rate of air in the axial direction of the main wings 210~280.

Obviously, the closed case 500 may have a variety of shapes and be made of a variety of materials.

Further, the air suction pipe 14 is connected to the variable throat 100 in order to guide a streamlined air flow therein.

Specifically, the air suction pipe 14 is connected to the sub-wings 310~380 and the main wings 210~280 to have a variable diameter.

As such, the air suction pipe 14 is provided with the variable throat 100, which may allow a streamlined flow of fluid such as air, minimize resistance to air flow so as to secure the flow rate of air supplied to the compressor, and reduce noise.

As described above, according to the exemplary embodiments of the invention, the variable throat device for an air compressor is disposed in an air suction passage of the compressor to change a cross-sectional area of the air suction passage through application of force in order to secure reliable flow control and may suppress generation of a vortex in an air stream in order to provide a significant reduction of unsteady flow.

In addition, the variable throat device of the present invention may secure a desired flow rate without pressure loss. Further, the variable throat valve may reduce load applied to a compressor impeller through stabilization of suction flow, thereby enabling a significant reduction in vibration of the impeller.

Although some embodiments have been provided to illustrate the present invention, it should be understood that these embodiments are given by way of illustration only, and that various modifications, variations, and alterations can be made without departing from the spirit and scope of the present invention. The scope of the present invention should be limited only by the accompanying claims and equivalents thereof.

What is claimed is:

1. A variable throat device for an air compressor, comprising:

a variable throat provided to an air suction pipe guiding a flow of air at atmospheric pressure into the compressor, the variable throat being pressed by external force to change a diameter of the air suction pipe to a streamline shape in order to reduce an unsteady flow of air while securing reliable flow control;

a plurality of main wings arranged along a circular trace to overlap each other such that a degree of overlap between the plurality of main wings is changed by external force to have a variable diameter, each of the plurality of main wings having elasticity and being connected at one side or opposite sides thereof to the air suction pipe in an axial direction; and a plurality of main fastening mechanisms each fastening adjacent main wings to allow the degree of overlap between the plurality of main wings to be changed;

wherein each of the plurality of main fastening mechanisms comprises: an elongated slot circumferentially formed at the other side of each of the plurality of main wings, a hole formed at one side of each of the plurality of main wings along the same circumferential trace as that of the slot, and a fastening pin fastening the slot of one main wing to the hole of another main wing adjacent the one main wing, so that the adjacent main wings overlap each other by a movable range of the fastener.

2. The variable throat device according to claim 1, wherein each of the plurality of main wings has one side overlapping an upper side of an adjacent main wing and the other side overlapping a lower side of another adjacent main wing to reduce an area of the device.

3. The variable throat device according to claim 1, wherein the variable throat further comprises:

a plurality of elastic sub-wings arranged along a circular trace to overlap each other such that a degree of overlap between the plurality of elastic sub-wings is changed by external force to allow the diameter of the plurality of main wings to be changed; and a plurality of sub-fastening mechanisms each fastening adjacent sub-wings such that the degree of overlap between the plurality of elastic sub-wings is changed.

4. The variable throat device according to claim 3, wherein the variable throat is disposed within a closed case.

5. The variable throat device according to claim 1, wherein the variable diameter of the plurality of main wings is changed by pushing force from a plurality of jaws circumferentially arranged to be moved forwards or backwards or to be rotated.

6. The variable throat device according to claim 1, wherein the air suction pipe comprises:

a plurality of outer wings having elasticity and arranged along a circular trace to overlap each other such that a degree of overlap between the plurality of outer wings gradually increases towards the variable throat in connection with variation of a diameter of the variable throat; and a plurality of outer fastening mechanisms each fastening adjacent outer wings to allow the degree of overlap between the plurality of outer wings to be gradually changed towards the variable throat in an axial direction of the plurality of outer wings.

7. The variable throat device according to claim 6, wherein each of the plurality of outer fastening mechanisms comprises:

an outer pivot hole formed at a portion of each of the plurality of outer wings placed at an opposite side to the variable throat in the axial direction;

an outer pivot pin simultaneously inserted into adjacent outer pivot holes to maintain a diameter of a portion of the air suction pipe corresponding to the outer pivot pin;

an elongated outer slot formed at the other side of each of the plurality of outer wings placed near the variable throat in the axial direction to be inclined with respect to a circumferential direction;

an outer hole formed at one side of each of the plurality of outer wings to be coincident with the outer slot of an adjacent outer wing; and an outer fastening pin inserted into the outer slot of one outer wing and the outer hole of another outer wing adjacent the one outer wing to guide variation of a diameter of a portion of the air suction pipe corresponding to the outer fastening pin.

8. The variable throat device according to claim 6, wherein the air suction pipe comprises:

a plurality of inner wings having elasticity and arranged along a circular trace to overlap each other to allow a degree of overlap therebetween to gradually increase towards the variable throat and to be changed according to pushing force of the plurality of outer wings; and a plurality of inner fastening mechanisms each fastening adjacent inner wings to allow the degree of overlap between the plurality of inner wings to be changed towards the variable throat in an axial direction of the plurality of inner wings.

9. A variable throat device for an air compressor, comprising:

a variable throat provided to an air suction pipe guiding a flow of air at atmospheric pressure into the compressor, the variable throat being pressed by external force to change a diameter of the air suction pipe to a streamline shape in order to reduce an unsteady flow of air while securing reliable flow control;

wherein the air suction pipe comprises:

a plurality of outer wings having elasticity and arranged along a circular trace to overlap each other such that a degree of overlap between the plurality of outer wings gradually increases towards the variable throat in connection with variation of a diameter of the variable throat; and a plurality of outer fastening mechanisms each fastening adjacent outer wings to allow the degree of overlap between the plurality of outer wings to be gradually changed towards the variable throat in an axial direction of the plurality of outer wings;

wherein each of the plurality of outer fastening mechanisms comprises:

an outer pivot hole formed at a portion of each of the plurality of outer wings placed at an opposite side to the variable throat in the axial direction;

an outer pivot pin simultaneously inserted into adjacent outer pivot holes to maintain a diameter of a portion of the air suction pipe corresponding to the outer pivot pin;

an elongated outer slot formed at the other side of each of the plurality of outer wings placed near the variable throat in the axial direction to be inclined with respect to a circumferential direction;

an outer hole formed at one side of each of the plurality of outer wings to be coincident with the outer slot of an adjacent outer wing; and an outer fastening pin inserted into the outer slot of one outer wing and the outer hole of another outer wing adjacent the one outer wing to guide variation of a diameter of a portion of the air suction pipe corresponding to the outer fastening pin.

* * * * *